United States Patent [19]

Wagner

[11] Patent Number: 5,046,431

[45] Date of Patent: Sep. 10, 1991

[54] RAILWAY TRUCK

[75] Inventor: John H. Wagner, Bradford Woods, Pa.

[73] Assignee: A. Stucki Company, Pittsburgh, Pa.

[21] Appl. No.: 577,053

[22] Filed: Aug. 31, 1990

Related U.S. Application Data

[63] Continuation of Ser. No. 504,687, Apr. 4, 1990, abandoned, which is a continuation of Ser. No. 284,676, Dec. 15, 1988, abandoned.

[51] Int. Cl.[5] ..... B61B 12/10

[52] U.S. Cl. ..... 105/198.4

[58] Field of Search ..... 105/198.2, 198.4, 198.5; 267/211, 214

[56] References Cited

U.S. PATENT DOCUMENTS

| | | | |
|---|---|---|---|
| Re. 31,008 | 8/1982 | Barber | 105/198.4 |
| 2,257,109 | 9/1941 | Davidson | 105/198.5 |
| 2,295,547 | 9/1942 | Cottrell | 105/198.2 |
| 2,324,267 | 7/1943 | Oelkers | 105/198.2 |
| 2,367,510 | 1/1945 | Light | 105/198.2 |
| 2,368,641 | 2/1945 | Cottrell | 105/198.2 |
| 2,408,866 | 10/1946 | Marquarot | 105/198.5 |
| 2,424,936 | 6/1947 | Light | 105/198.5 |
| 2,434,838 | 1/1948 | Cottrell | 105/198.2 |
| 2,456,635 | 12/1948 | Heater | 105/198.4 |
| 2,458,210 | 1/1949 | Schlegel, Jr. | 105/198.2 |
| 2,528,473 | 10/1950 | Kowalik | 105/198.5 |
| 2,570,159 | 10/1951 | Schlegel, Jr. | 105/198.4 |
| 2,650,550 | 9/1953 | Pierce | 105/198.5 |
| 2,661,702 | 12/1953 | Hamilton | 105/198.4 |
| 2,688,938 | 9/1954 | Kowalik | 105/198.5 |
| 2,853,958 | 9/1958 | Neumann | 105/198.2 |
| 3,026,819 | 10/1962 | Cope | 105/198.2 |
| 3,670,660 | 6/1972 | Weber et al. | 105/171 |
| 3,687,086 | 8/1972 | Barber | 105/198.4 |
| 4,109,585 | 8/1978 | Brose | 105/198.4 |
| 4,179,995 | 12/1979 | Day | 105/198.4 |

*Primary Examiner*—Sherman D. Basinger
*Assistant Examiner*—Virna L. Mojica
*Attorney, Agent, or Firm*—Carothers & Carothers

[57] ABSTRACT

A railway truck assembly having a bolster and side frames with a novel arrangement of solid lateral stops which limit movement of the bolster ends with respect to the side frames of the truck, the novel lateral stops also accommodating an improved column friction damping arrangement for such a railway truck assembly.

19 Claims, 2 Drawing Sheets

RAILWAY TRUCK

Figure 1:
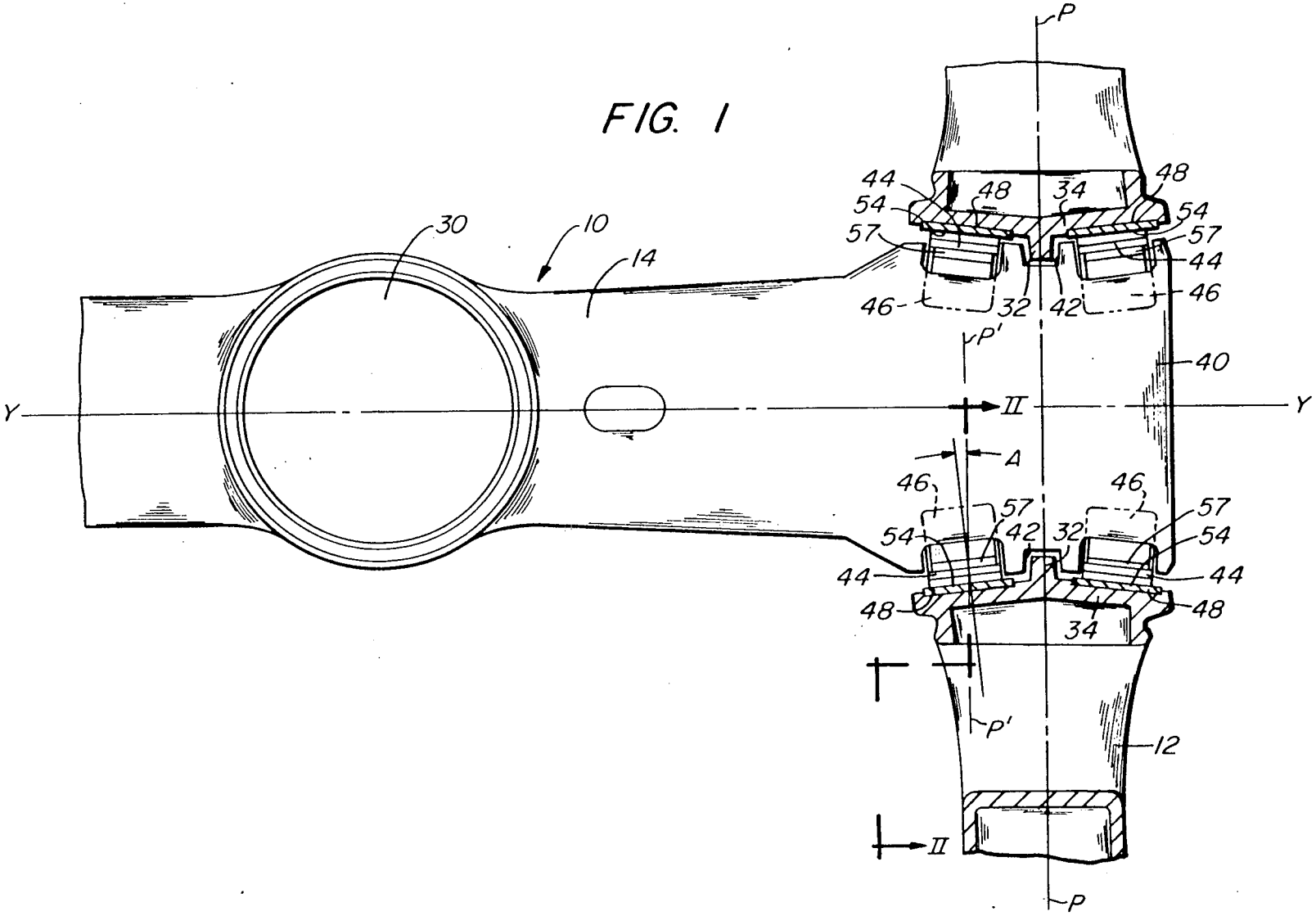

This a continuation of co-pending application Ser. No. 07/504,687 filed on Apr. 4, 1990 now abandon which is a continuation of co-pending application Ser. No. 07/284,676 filed on 12/15/88, now abandoned.

BACKGROUND OF THE INVENTION

In the railway industry it has been common practice to support the opposed ends of a freight car body on spaced-apart, wheeled truck assemblies for movement along a railway track. The standard truck assembly is the three-piece truck, so called because its principal structural members are a pair of elongated side frames which extend generally longitudinally of the railway track between a pair of spaced wheelsets, and an elongated bolster which extends transversely of the track and has its opposed ends supported by the respective side frames.

In a conventional truck, each longitudinal end of the bolster is received in a respective opening or window formed intermediate the longitudinal ends of the respective side frame and is supported therein by a suspension system including a spring set which permits movement of the bolster relative to the side frame. The springs typically extend between a spring seat in the side frame opening and a respective undersurface of the bolster end which is spaced above the side frame spring seat. The bolster ends thus are supported for movement within predetermined ranges of lateral and vertical motion. Lateral deflection of the springs is limited by pairs of bolster stops or gibs disposed to engage the laterally opposed sides of the two spaced columns of each side frame, and vertically downward spring deflection is limited by the deflection at which the spring coils are in solid, vertically abutting engagement.

Other modes of relative motion between the bolster and the side frames in conventional three-piece trucks include relative bolster rotation about axes extending longitudinally of the bolster or longitudinally of the side frames, as well as about axes which are perpendicular to both of these. For example, movement of the truck to an out-of-square or warped configuration involves relative rotation of the bolster with respect to the side frames about a vertical axis.

The railway track on which frieght cars run often is non-uniform due to such causes as differential settling that results from non-uniform ballast or foundation under the railway ties, non-uniform rail wear and rail misalignment. As a result, vertical and lateral track variations can impart energy to the truck suspension system and in turn cause the car body to rock, bounce or sway. With commonly used spring suspension systems, a railway car body has a natural resonant frequency of sway and bounce. If the track conditions are such as to cause the car body to sway or bounce at its resonant frequency, the resulting car body motion can force the suspension against its lateral and vertical mechanical limits, characterized above as solid springs vertically and rigid bolster gibs laterally.

In a conventional truck the rigid bolster gibs confront laterally opposed reaction surfaces disposed on laterally opposite sides of the respective side frame columns adjacent sidewall portions of the side frame window within which a bolster end is received. The space between the opposed gibs exceeds the spacing between the respective side frame reaction surfaces by a given dimension which determines the magnitude of available bolster movement in the lateral direction, i.e., transversely of the tracks. Similarly, the geometry and dimensioning of the conventional gibs defines the limits of such other modes of relative motion as rotation of the bolster with respect to the side frames about vertical axes, and rocking of the side frame about its longitudinal axis.

In one of the most common expendients presently being employed to control car body rock and sway, the energy input to the suspension systems of rail car trucks is dissipated by use of bolster friction elements which utilize rigid (commonly metallic) friction wedges or friction shoes to damp relative motion between the truck bolster and the side frames. Elastomeric friction shoes, as well as combined elastomeric and rigid friction shoe assemblies are also known. Nearly all freight car trucks built within the past 40 years have included bolsters with opposed pockets formed in the longitudinal ends thereof that receive such friction elements for the purpose of damping or dissipating the kinetic energy of relative bolster-to-side frame motion.

Conventional friction assemblies have provided not only frictional energy dissipation to damp relative movement between the bolster and the side frames, but also bolster-to-side frame fit up and a degree of control over certain modes of relative motion to which the bolster and side frame assembly may be subjected.

In addition to rigid or elastomeric friction elements, hydraulic snubbers are also used to dissipate the energy input to railway car trucks; however, hydraulic snubbers do not rely upon dry or coulomb friction to dissipate energy. Such snubbers are mentioned here only to emphasize that control of relative bolster and side frame motion requires control of the force inputs to the railway truck by conversion of sufficient kinetic energy into heat energy, and thereafter dissipation of the heat energy to the atmosphere.

Practitioners in the art have continually sought to develop improved structures for controlling and limiting relative motion between the truck side frames and bolster, including but not limited to various arrangements of friction elements with angled or inclined biasing surfaces that are engageable with cooperably angled column guide surfaces of the side frames to provide improved modes of control over relative bolster-to-side frame motion, for example, as disclosed in U.S. Pat. No. Re. 31,988.

Other patent art known to the Applicant herein which relates generally to friction elements for railway truck bolster-to-side frame fit up includes the following, all generally pertaining to double friction shoe arrangements in the opposed bolster pockets, or contoured bolster pockets: U.S. Pat. Nos. 2,434,838, 2,458,210, 3,687,086, 2,257,109, 2,408,866, 2,424,936, 2,456,635, 2,528,473, 2,570,159, and 3,026,819 all relate to vertically split two-piece friction wedges; U.S. Pat. Nos. 2,324,267, 2,367,510, 2,650,550, 2,661,702, 2,688,938, and 2,853,958 all pertain to contoured column wear plate configurations such as sloped or tapered friction element contact surfaces; U.S. Pat. Nos. 4,179,995 and 3,670,660 pertain to railway truck bolster gib arrangements other than the commonly encountered bolster gibs which are engageable with laterally opposed contact surfaces of the respective side frames.

BRIEF SUMMARY OF THE INVENTION

The present invention contemplates, in one presently preferred embodiment thereof, a novel and improved railway car truck with solid stops disposed within the lateral span between the laterally opposed sides of the side frame, and preferably at the lateral center of the side frame column, for limiting relative bolster-to-side frame motion. The solid stops are incorporated in the side frames as elongated, vertically extending gibs, preferably located essentially on the central vertical plane of each side frame between a pair of laterally spaced column wear surfaces. A pair of such gibs projects inwardly, respectively, from the longitudinally opposed ends of the side frame window into the space encompassed thereby, and complementary elongated gib receiving grooves are formed on opposed surfaces of the bolster end to engage the respective side frame gibs. The gibs thus limit the range or magnitude of various modes of relative bolster-to-side frame motion, including but not limited to bolster movement laterally with respect to the side frames, and relative bolster-to-side frame rotation about vertical, longitudinal (i.e., extending longitudinally of the side frames), and lateral (i.e., extending laterally of the side frames) axes.

The invention not only offers improved uniformity and symmetry of the loading imposed when the solid or rigid stops are engaged, it also provides side frame and bolster structures of improved mechanical integrity and design simplicity. For example, locating the longitundianlly projecting gibs on the side frames rather than on the bolster permits a reduced overall length dimension for the side frame window as compared to the windows of conventional side frames which are required to have a sufficient overall length to accommodate end-wise passage therethrough of the bolster end and its gibs during truck assembly. With this invention, the reduced longitudinal dimensional requirement for the side frame window affords correspondingly improved structureal strength.

The invention also contemplates laterally spaced friction members for use preferably in conjunction with the above-characterized gib arrangement with the gibs located laterally intermediate respective pairs of laterally spaced column wear surfaces. The friction members and their respective pockets and wear surfaces preferably are disposed in angled or canted configurations for fit up between the bolster and side frames of a railway truck. It is known, for example from the above cited U.S. Pat. No. Re. 31,988 to provide laterally inclined or canted surfaces on friction members to engage complementary column guide wear surfaces. However, the present invention contemplates column guide wear plates with generally vertically extending, laterally adjacent and preferably flat wear surface portions which are disposed so as to extend in non-parallel planes away from the longitudinally disposed central vertical plane of the side frame. The longitudinal end-to-end dimension of the side frame window between the opposed column wear surfaces is a minimum adjacent the central vertical plane of the side frame and increases continuously to a maximum adjacent the laterally outermost edges of the respective wear surface portions spaced farthest from the central vertical plane. Accordingly, the respective wear surface portions also diverge in their laterally outward extent away from a bolster end received in the respective side frame window.

To accommodate friction elements or assemblies for engagement with angled column wear surface portions, the opposed sides of the bolster ends confronting the respective side frame columns are provided with pairs of pockets that are angled or canted in a manner complementary to the angular relationship of the respective column wear surface portions. Each angled pocket receives an interchangeable friction element or assembly for engagement with the respective column guide wear surface portion. Each such friction assembly may be maintained in the operative position by retention springs, and in addition each preferably includes a resiliently deformable load bearing element other than the retention springs, an elastomeric element for example, which deforms under load and in response to relative bolster-to-side frame motion to assist in accommodation of such relative motion.

The angled bolster pockets and complementary column wear surfaces provide a centering effect which tends to center the bolster ends with respect to the lateral extent of the side frames as lateral movement in either direction from a centered position results in increasing load and compressive deformation on the elastomeric elements in certain ones of the friction assemblies, and reduced load and compressive deformation on the elastomeric elements in others of the friction elements. The resulting force imbalance tends to urge the bolster and side frame toward a laterally centered configuration. Differential deformation of the retention springs also contributes to the centering effect.

In the same manner, the canted friction elements or assemblies also offer improved resistance to rotation of the bolster with respect to the side frames about vertical axes. Specifically, the increasing compressive force on one pair of diagonally opposed friction assemblies which results from such rotation, as well as the reduced compressive force on the other pair of diagonally opposed friction assemblies, is applied with enhanced symmetry and uniformity due to the angled orientation of the pocket and column wear surfaces as described to resist bolster rotation about generally vertical axes with respect to the side frames.

The friction elements also dampen the kinetic energy of relative bolster-to-side frame movement as in conventional trucks and reduce shock and impact loads between the centrally disposed gibs and the complementary bolster groove surfaces. Wear on these surfaces thus is reduced and their service life correspondingly enhanced. Both the centered disposition of the gibs, and the form or contour of the mutually engageable gib and groove surfaces reduce stress in the solid stop contact surface areas.

Of course it is to be understood that deformable elastomeric portions per se, such as above specified, are known in the art and form a part of the instant invention only insofar as they cooperate with other novel elements of the invention to provide novel structural combinations.

It is therefore one general object of the invention to provide a novel and improved railway truck assembly.

Another object of the invention is to provide a novel method of controlling the relative bolster-to-side frame motion in a railway truck assembly.

A more specific object of the invention is to provide a railway car truck assembly including a bolster and a pair of side frames, with the side frames having rigid stops which cooperate with the respective bolster ends and column wear surfaces disposed laterally to either side of the rigid stops to control relative movement between the bolster and the side frames.

Another object of the invention is to provide a novel structural arrangement of friction assemblies and solid stops in a railway truck assembly for limiting the range of relative motion between the bolster and the side frames.

A further specific object of the invention is to provide a railway car truck bolster with pockets having confining surfaces which receive column centering friction elements or assemblies in an orientation of symmetry with respect to angled or canted surfaces of the respective column guide wear plate so as to reduce or eliminate unsymmetrical bolster pocket restraining forces.

A further general object of the invention is to provide a railway car truck assembly for higher capacity freight cars with optimally combined increased capacity column damping and suspension motion control.

Figure 2:
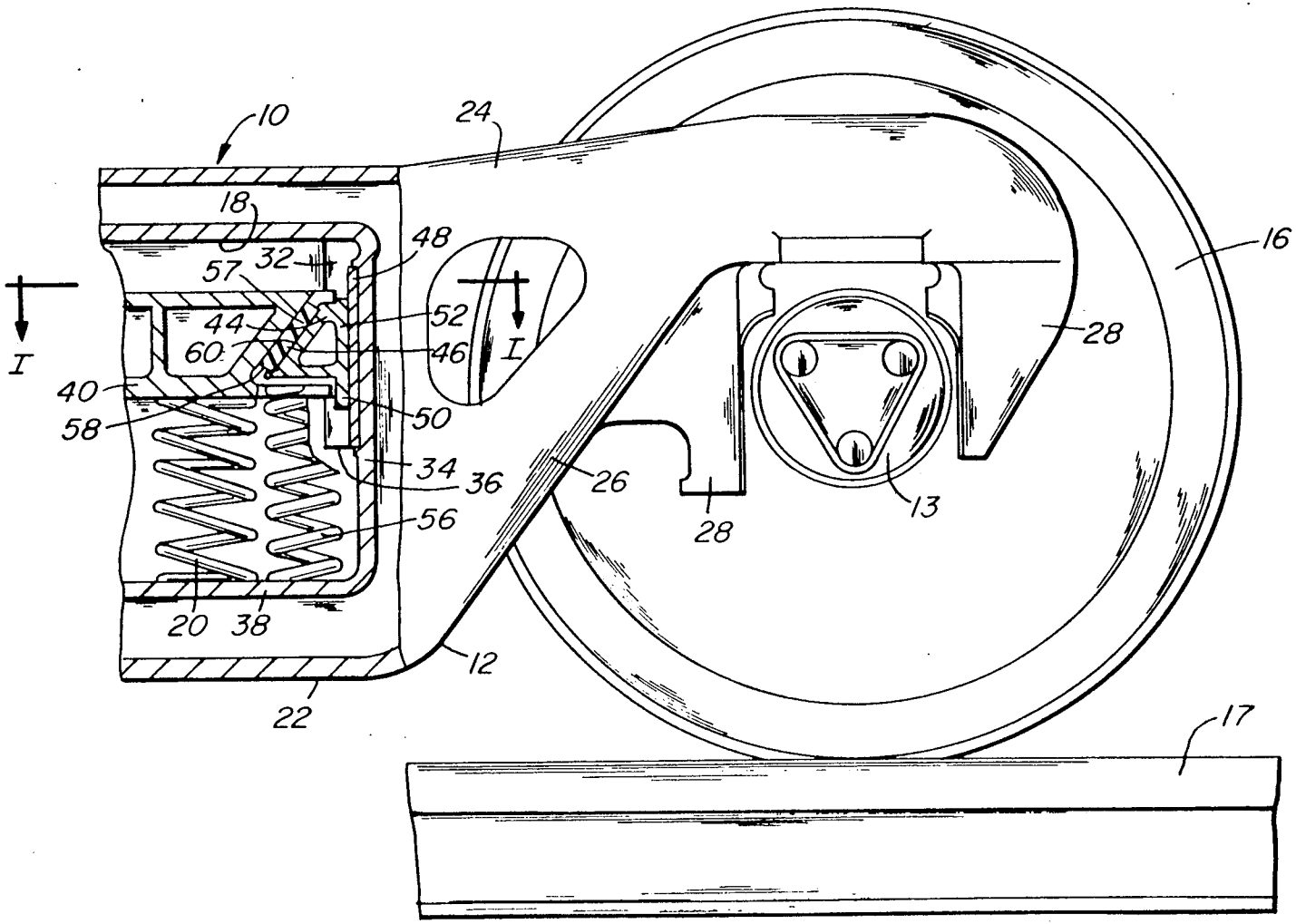

These and other objects and further advantages of the invention will be more readily understood upon consideration of the following detailed description and the accompanying drawings, in which:

FIG. 1 is a partially sectioned top plan view of a fragmentary portion of a railway truck constructed according to principles of the present invention; and FIG. 2 is a sectioned side elevation taken on line II—II of FIG. 1, and showing section line I—I on which FIG. 1 is taken.

There is generally indicated at 10 in FIGS. 1 and 2 a railway car truck assembly according to one presently preferred embodiment of the invention and of a type commonly known as a three-piece truck. Truck 10 comprises a pair of elongated side frames 12 (a fragmentary part of only one being shown in FIGS. 1 and 2), and an elongated bolster 14, also shown in fragmentary part. The side frames 12 are spaced laterally apart and supported adjacent the opposed journal ends 13 of a pair of well known wheel and axle sets 16 (only one wheelset 16 being shown), and the longitudinal ends 40 of bolster 14 are captively received and retained within respective openings or windows 18 of the side frames 12 for support therein by springs of a conventional spring group 20.

As is well known, each side frame 12 may be a unitary structure including a central box frame portion 22 which frames the window 18. An upper compression portion 24 and a lower tension portion 26 extend longitudinally outward from each longitudinal end of box frame portion 22 and merge adjacent a respective pair of pedestal jaw portions 28 at each longitudinal end of the side frame 12. The pedestal jaws 28 receive the bearing journals 13 of the respective wheel and axle sets 16 which are spaced along conventional tracks 17 to support the side frames 12. A center plate portion 30 of each bolster 14 rotatably engages the complementary center plate (not shown) of a car body for support thereof in the usual manner.

All of the above-described elements are well known structures in the art and form a part of the instant invention only insofar as the novel structure of the invention is incorporated in them to form structural combinations as hereinbelow described. Further detailed description of these known elements thus is believed to be unnecessary.

On further reference to FIGS. 1 and 2, it will be seen that the support structure for positioning and retaining a bolster end 40 with respect to a side frame 12 preferably includes a pair of vertically extending gibs 32 formed integrally with longitudinally opposed sidewall portions 34 of box frame portion 22 and projecting longitudinally into window opening 18. Preferably, the position of gibs 32 coincides essentially with the vertically oriented central longitudinal plane P—P of the respective side frames 12 (FIG. 1) such that each gib 32 extends generally in symmetry about the vertical plane P—P. Further, as shown in FIG. 2 gibs 32 extend vertically downwardly from an upper part of window 18 to a terminal point 36 spaced above the base or floor 38 of window 18.

The cooperating end portions 40 of bolster 14 are assembled to side frames 12 by sliding the bolster end 40 into window 18 vertically intermediate gibs 32 and window base 38. Thus, each bolster end 40 includes a pair of opposed, vertically extending, and open-ended grooves 42 which are dimensioned in cross section to receive the respective gibs 32 and thereby captively retain the bolster end 40 within window 18 when the bolster end is supported vertically intermediate of the opposed ends of gibs 32 by the springs of spring group 20.

The dimensions of grooves 42 are chosen with respect to those of gibs 32 so as to provide solid stops which impose suitable and desirable motion limits for the relative movement between the bolster 14 and side frames 12. The engagement of gibs 32 in grooves 42 provides such motion limits for all modes of relative motion between the bolster 14 and side frame 12 except relative vertical motion. The gibs 32 and cooperating grooves 42 thus limit all such relative movement as, for example, relative lateral motion and relative rotation about vertical, longitudinal and lateral axes of rotation, as well as all the more complex motions made up of combinations of these.

By virtue of the desired solid stops, the forces imposed on bolster 14 and side frames 12 at any point of contact between the engaged gibs 32 and grooves 42 are more symmetrically and uniformly distributed throughout the supporting structures than in conventional bolster gib arrangements. A further advantage of the described structure is that the gibs 32 are carried by the side frames 12 rather than by the bolster 14. This affords a side frame structure of greater strength as the window 18 may be of shorter longitudinal dimension than in conventional side frames. The smallest longitudinal dimension for the window 18 is determined by the longitudinally innermost projection of gibs 32. As it is known to be desirable to keep the side frame window as small as practicable for optimal structural integrity, the described structure not only provides improved modes of load bearing capability under solid stop contact conditions, but in addition provides a stronger and more structurally sound side frame.

Another aspect of the presently preferred embodiment of the invention concerns the use of a plurality of frictional damping assemblies 44 received in respective open-ended pockets 46 formed in bolster ends 40. The pockets 46 open longitudinally outwardly to confront wear surfaces 54 of respective wear plates 48 carried adjacent the respective side wall portions 34 of the box frame portion 22. Pockets 46 receive frictional damping assemblies 44 such that for each one a friction surface 50 of a shoe 52 (preferably a rigid shoe) is maintained in frictional engagement with the complementary wear surface portion 54 by the bias of a compressed retention spring 56. Each friction assembly 44 preferably also includes an elastically deformable member 57 which is captively received between the sloping rearward pocket surface 58 and a complementary sloped surface 60 of the friction shoe 52.

Each end 40 of bolster 14 includes pairs of opposed pockets 46 which confront respective wear surfaces 54, and each pocket 46 receives a friction assembly 44. Pockets 46 are oriented at an angle A with respect to a vertical plane P'—P' which is parallel to plane P—P such that the friction assemblies 44 received in pockets 46 project outwardly of the pockets 46 and are angled toward one another. The respective friction surfaces 50 thus are not parallel but rather form a shallow, outwardly opening V or chevron configuration. Accordingly, the side wall portions 34 of box frame 22 outwardly adjacent the bolster pockets 46 and the cooperating wear plates 48 present column wear surfaces 54 in an orientation for complementary engagement with the respective friction shoe surfaces 50. That is, the planes of wear surfaces 54 also form a shallow V or chevron configuration which complements that formed by surfaces 50.

The above-described angled or canted configuration of the installed friction assemblies 44 provides a self-centering effect which is operative in response to relative lateral motion of bolster 14 with respect to plane P—P of a side frame 12, to restore the bolster 14 and side frames 12 to a laterally centered configuration if they deviate from the same. This centering effect results as relative lateral displacement causes the clearance between the pocket 46 and the respective wear surface 54 on one side of plane P—P to decrease, while the clearance between the pocket 46 and surfaces 54 on the other side of plane P—P increases. Accordingly, the friction assemblies 44 to one side of plane P—P move incrementally down the slope of respective pocket surfaces 58 to increase the bias of their respective retention springs while those on the opposite side of the plane P—P simultaneously move incrementally up the slope of respective pocket surfaces 58 thus incrementally reducing their retention spring bias. The resulting differential compression of the respective springs 56 urges the bolster and side frame toward a laterally centered configuration where the retention springs 56 experience equal magnitudes of a compression.

For the embodiment shown, which includes compressively deformable elastomeric elements 57, when a bolster end 40 moves laterally with respect to the side frame 12 with which it is engaged, the pair of longitudinally opposed friction assemblies 44 on one side of plane P—P also experience an increase in the magnitude of compressive deformation of their elastomeric elements 57 while the elastomeric elements 57 in the other pair of opposed friction assemblies experience a reduction in their magnitude of compressive deformation. The innate tendency of the assembly to balance or equalize the compressive loads in the four elastomeric elements 57 thus provides further impetus toward the desired lateral centering effect. The tendency to equalize the magnitude of compressive loading among the four friction assemblies 44 in each bolster end-to-side frame fit up also tends to restore an out of square or warped truck to a square configuration, and to resist other modes of relative motion between bolster 14 and side frames 12, including rotation of the bolster and/or side frames about longitudinal axes.

Preferably, each set of four friction assemblies 44 is arranged with the friction assemblies in respective pairs on opposed sides of a bolster end 40 with one friction assembly 44 of each such pair being disposed to either side of the grooves 42 which receive gibs 32.

From the above description it will be seen that the present invention affords a novel railway truck having improved structures for controlling and limiting relative motion between the bolster and side frames of the truck. In addition to the advantages of improved structural symmetry and uniformity of loading, the invention also affords improved side frame structural integrity through reduced dimensional requirements for the side frame window opening, and reduced wear on bolster pocket and friction assembly elements through incorporation of bolster pockets which are square to respective non-parallel column guide wear plate friction surfaces.

Of course it will be appreciated that various modified and alternative embodiments other than the preferred embodiments herein disclosed are possible. For example, although less desirable, gibs 32 could be appended to the bolster instead of the side frame and still achieve many of the desirable lateral bolster-to-side frame motion limit advantages. In this instance the groove for receiving such a bolster gib would be incorporated in the side frame columns as can be readily appreciated. I have contemplated this and other alternative embodiments, and such surely would also occur to others versed in the art, once apprised of may invention. Accordingly, it is intended that the invention be construed broadly and limited only by the scope of the claims appended hereto.

I claim:

1. In a railway truck including a pair of laterally spaced elongated side frames each having a pair of spaced apart upstanding column portions and an elongated bolster which is adapted to be assembled with such side frames by having the longitudinally opposed ends thereof received longitudinally intermediate such column portions, respectively, the combination for limiting movement of such bolster with respect to such a side frame comprising:

such column portions including column surface means to provide in such side frames a pair of opposed column surface means which are spaced longitudinally apart to receive such a bolster end therebetween;

each such bolster end including longitudinally outwardly opening pocket means disposed for confronting relation with said column surface means respectively, when such a bolster end is received therebetween;

friction means received within said pocket means and extending intermediate each bolster end and the respective said column portions, and having surface means which are engageable in frictional engagement with the respective said column surface means;

means for biasing said friction means into said pockets, respectively, and for maintaining said surface means thereof in biased engagement with said column surface means, respectively;

said friction means being laterally slideable on said column surface means and cooperable with said pocket means in a manner to accommodate relative lateral movement of such a bolster with respect to such side frames;

a first rigid retention means carried by such a bolster end;

a second rigid retention means carried by such a side frame and cooperable with said first rigid retention means to limit the magnitude of such relative lateral movement of such a bolster with respect to such a side frame; and said second rigid retention means being disposed entirely within the lateral extent of said column surface means.

2. The combination as set forth in claim 1 wherein each said friction means includes a pair of laterally spaced friction members disposed intermediate each said column surface means and the adjacent said pocket means.

3. The combination as set forth in claim 2 wherein said first and second retention means are cooperable in mutually interlocking engagement.

4. The combination as set forth in claim 3 wherein said first and second rigid retention means, when in said mutually interlocking engagement, are disposed laterally intermediate the respective said pair of laterally spaced friction assemblies.

5. The combination as set forth in claim 4 wherein said rigid retention means includes a vertically extending gib portion of such a side frame and a cooperating groove portion of such a bolster end.

6. The combination as set forth in claim 5 wherein said grib portion is disposed essentially symmetrically with respect to a centrally disposed, vertical longitudinal plane of such a side frame.

7. The combination as set forth in claim 6 wherein each said pair of laterally spaced friction assemblies is disposed with one said friction assembly located to either lateral side of said groove portion.

8. The combination as set forth in claim 7 wherein each said column surface means includes a pair of laterally spaced column surface portions extending laterally outward in opposed directions from said gib portion.

9. The combination as set forth in claim 8 wherein said pair of laterally spaced column surface portions diverse laterally outward and longitudinally away from such a bolster end.

10. The combination as set forth in claim 9 wherein each said pocket means includes a pair of laterally spaced pockets formed in such a bolster end for confronting relation with each respective said pair of laterally spaced column surface portions to receive respective pairs of said friction members.

11. The combination as set forth in claim 10 wherein said groove portions are disposed laterally intermediate said laterally spaced pockets, respectively.

12. The combination as set forth in claim 1 wherein said friction means is additionally cooperable with said column surface means and said pocket means to continuously urge such bolster toward a laterally centered position with respect to such side frames.

13. A railway truck comprising:

a pair of laterally spaced elongated side frames and an elongated bolster;

each said side frame having an opening extending intermediate a pair of longitudinally spaced upstanding column portions and said bolster having a pair of longitudinally opposed end portions which are assembled with said side frames by being received within said openings intermediate said pairs of spaced column portions, respectively;

said pairs of column portions including respective pairs of opposed column surface means which are spaced longitudinally apart to receive said bolster ends therebetween, respectively;

each said bolster end including longitudinally outwardly opening pocket means disposed for confronting relation with said pair of opposed column surface means, respectively, when said bolster end is received therebetween;

friction means received within said pocket means and extending intermediate the respective said bolster end and column portions, and having surface means which are engageable in frictional engagement with the respective said column surface means;

means for biasing said friction means into said pockets, respectively, and for maintaining said surface means thereof in biased engagement with said column surface means, respectively;

said friction means being laterally slidable with respect to said column surface means and cooperable with said pocket means in a manner to accommodate relative movement of said bolster laterally of said side frames;

first rigid retention means carried by said bolster ends, respectively;

second rigid retention means carried by said side frames and cooperable with said first rigid retention means, respectively, to limit the magnitude of such relative movement of said bolster laterally of said side frames; and said second rigid retention means being disposed entirely within the lateral extent of said column surface means.

14. The combination as set forth in claim 13 wherein said friction means is additionally cooperable with said column surface means and said pocket means to continuously urge said bolster toward a laterally centered position with respect to said side frames.

15. A railway truck comprising:

a pair of laterally spaced elongated side frames and an elongated bolster;

each said side frame having an opening extending intermediate a pair of longitudinally spaced upstanding column portions and said bolster having a pair of longitudinally opposed end portions which are received within said openings intermediate said pairs of spaced column portions, respectively;

said pairs of column portions including respective pairs of opposed column surface means which are spaced longitudinally apart to receive said bolster ends therebetween, respectively;

each said bolster end including longitudinally outwardly opening pocket means disposed for confronting relation with said pairs of opposed column surface means, respectively, when said bolster end is received therebetween;

each said bolster end and the respective said column portions being adapted to receive friction means in biased engagement within the respective said pocket means with such friction means extending outwardly therefrom toward said column portions, respectively, for biased frictional engagement with the respective said column surface means and for lateral sliding with respect to said column surface means to accommodate relative movement of said bolster laterally of said side frames;

first rigid retention means carried by bolster ends, respectively;

second rigid retention means carried by said side frames and cooperable with said first rigid retention means, respectively, to limit the magnitude of such relative movement of said bolster laterally of said side frames; and said second rigid retention means being disposed entirely within the lateral extent of column surface means.

16. A railway truck comprising:

a pair of laterally spaced elongated side frames and an elongated bolster;

each said side frame having a pair of longitudinally spaced upstanding column portions with opposed surface means and said bolster having longitudinally opposed end portions which are received intermediate said opposed surface means, respectively;

each said bolster end being adapted to retain means extending outwardly thereof to engage said opposed surface means, respectively, to confine said bolster ends with respect to said column portions, respectively, while permitting said bolster ends to move laterally with respect to said column portions, respectively, within a given range of lateral freedom;

said bolster ends having first rigid retention means, respectively;

said side frames having second rigid retention means cooperable with said first rigid retention means, respectively, to accommodate lateral movement of said bolster ends with respect to the respective said column portions within said given range of lateral freedom and to limit the magnitude of said given range of lateral freedom; and said second rigid retention means being disposed entirely within the lateral extent of said column portions.

17. The railway truck as set forth in claim 16 wherein said rigid retention means includes a vertically extending gib portion of said side frame and a cooperating groove portion of said bolster end.

18. The railway truck as set forth in claim 17 wherein said gib portion is disposed essentially symmetrically with respect to a centrally disposed, vertical longitudinal plane of said side frame.

19. The railway truck as set forth in claim 18 wherein each said column portion includes a pair of laterally spaced column surfaces which extend laterally outward in opposed directions from said gib portion.

* * * * *